US005653297A

United States Patent [19]

Whisenhunt

[11] Patent Number: 5,653,297

[45] Date of Patent: Aug. 5, 1997

[54] BLASTHOLE DRILL WITH IMPROVED AUTOMATIC BREAKOUT WRENCH

[75] Inventor: H. Dewain Whisenhunt, Mukwonago, Wis.

[73] Assignee: Harnischfeger Corporation, St. Francis, Wis.

[21] Appl. No.: 423,657

[22] Filed: Apr. 14, 1995

[51] Int. Cl.[6] ..... E21B 3/00; E21B 19/00; B25B 13/50

[52] U.S. Cl. ..... 175/52; 175/85; 175/162; 173/164; 81/57.33

[58] Field of Search ..... 175/52, 85, 161, 175/162, 203, 220; 173/164; 81/57.33

[56] References Cited

U.S. PATENT DOCUMENTS

| | | | |
|---|---|---|---|
| 3,680,412 | 8/1972 | Mayer et al. | 175/85 X |
| 3,832,918 | 9/1974 | Lang et al. | 81/57.33 |
| 3,915,243 | 10/1975 | Hisey et al. | 173/164 X |
| 3,920,087 | 11/1975 | Hisey et al. | 175/85 X |
| 4,128,135 | 12/1978 | Mitchart et al. | 175/52 |
| 4,194,419 | 3/1980 | Mitchhart et al. | 81/57.33 |
| 4,194,579 | 3/1980 | Bailey et al. | 175/57 |
| 5,105,687 | 4/1992 | Paech | 74/661 |
| 5,172,613 | 12/1992 | Wesch, Jr. | 81/57.33 |

OTHER PUBLICATIONS 3 sheets of Gardner–Denver Co. Drawing. No. 301174 dated Jan. 25, 1982.

Driltech Inc. Parts Manual (Model C90K–D) S/N 731,882; dated Oct. 4, 1993; p. 12–4 (1 of 4 and 2 of 4).

3 sheets of Harnischfeger Drawing No. 100J6640; dated Aug. 24, 1992.

*Primary Examiner*—Frank Tsay

*Attorney, Agent, or Firm*—Michael, Best & Friedrich

[57] ABSTRACT

An automatic breakout wrench with: the clamping jaw located on the inside of the pipe so that the clamping grip is not reduced by the force of the breakout cylinder; the orientation of the breakout cylinder resulting in the breakout cylinder creating a moment that forces the wrench toward the pipe rather than away from the pipe; pivotal movement of the wrench member guided by three pins; the wrench member pivoting twenty-four degrees; the clamping jaw pivotally mounted on one of the pins guiding movement of the wrench member; and shims secured in a manner so as to be easily inserted and removed.

17 Claims, 6 Drawing Sheets

BLASTHOLE DRILL WITH IMPROVED AUTOMATIC BREAKOUT WRENCH

BACKGROUND OF THE INVENTION

Blasthole drills are large machines used to drill holes for explosives in mining operations. A conventional blasthole drill comprises a frame supported by crawlers for movement over the ground, and a mast supported by the frame for movement between a substantially vertical position and a number of angled or non-vertical positions. The mast defines a drill hole axis. A rotary head moves relative to the mast along the drill hole axis. The rotary head engages the upper end of a drill pipe for rotating the drill pipe and driving the drill pipe into the ground. When drilling a blasthole that is deeper than the height of the mast, more than one section of drill pipe must be used. After the first section of drill pipe is driven into the ground, the rotary head moves back to the top of the mast and another section of drill pipe is connected to the top of the first section. The rotary pipe then drives the second section into the ground. It is not unusual to use four sections of drill pipe. Such a deep blasthole is referred to as a "multi-pass" blasthole.

After drilling a multi-pass blasthole, it can be difficult to break the joint between two pipe sections. A blasthole drill typically includes an automatic breakout wrench for breaking a joint if the rotary head cannot do so. An automatic breakout wrench is disclosed in U.S. Pat. No. 4,128,135. The automatic breakout wrench turns the upper pipe section while the lower pipe section is held by deck wrenches.

A conventional wrench includes a swing arm pivotable relative to the mast between extended and retracted positions. A wrench member pivots relative to the swing arm about the drill hole axis when the swing arm is in the extended position. The wrench member carries dies for gripping the pipe section. Movement of the wrench member relative to the swing arm is guided by two pins which extend from the wrench member and which move in arcuate slots in the swing arm. A clamping jaw pivots relative to the wrench member between a clamping position and a non-clamping position. The jaw carries a die for gripping the pipe section. When the swing arm is in the extended position, movement of the jaw to the clamping position causes the pipe section to be gripped by the dies on the jaw and on the wrench member. Thereafter, pivotal movement of the wrench member relative to the swing arm (the clamping jaw moves with the wrench member) turns the pipe section to break the joint. Pivotal movement of the wrench member is caused by a hydraulic breakout cylinder connected between the swing arm and the wrench member.

SUMMARY OF THE INVENTION

Conventional automatic breakout wrenches have several disadvantages. The wrench member and the clamping jaw are typically arranged such that the force exerted by the breakout cylinder while breaking the joint both reduces the force of the clamping jaw and creates a moment that forces the wrench away from the pipe section. Also, the stroke of the breakout cylinder and the resulting arcuate movement of the wrench member can be insufficient to break some joints. Furthermore, conventional breakout wrenches are not readily adjustable to accommodate different pipe diameters and to allow for pipe wear.

The invention provides an improved automatic breakout wrench that has several advantages over conventional wrenches. The clamping jaw is relocated, on the inside of the pipe, so that the clamping grip is not reduced by the force of the breakout cylinder. The orientation of the breakout cylinder results in the breakout cylinder creating a moment that forces the wrench toward the pipe rather than away from the pipe. Pivotal movement of the wrench member is guided by three pins, rather than the usual two, for increased stability. The wrench member pivots twenty-four degrees, rather than the usual eighteen degrees, for more effective joint breaking. The clamping jaw is pivotally mounted on one of the pins guiding movement of the wrench member, thereby providing a more economical construction. Shims allow adjustment of the dies to compensate for pipe wear and to accommodate different pipe sizes. The shims are secured in a manner so as to be easily inserted and removed.

More particularly, the improved breakout wrench includes a swing arm mounted on the mast for pivotal movement between extend and retracted positions. The swing arm has therein three separate, arcuate slots centered on a pivot axis which is coaxial with the drill hole axis when the swing arm is in its extended position. One slot is spaced farther from the pivot axis than are the other two slots. A swing hydraulic assembly pivots the swing arm between its extended and retracted positions.

The breakout wrench also includes a wrench member having thereon three pins, each of which is received in a respective one of the swing arm slots for guiding pivotal movement of the wrench member about the pivot axis. A clamping jaw is supported by another one of the pins for pivotal movement relative to the wrench member and between clamping and non-clamping positions. The clamping jaw axis is located "inside" the pipe section to improve gripping of the pipe sections during breaking of the joint. The wrench member and the clamping jaw are pivoted relative to the swing arm by a breakout hydraulic assembly connected between the swing arm and the pin farthest from the pivot axis. The breakout hydraulic assembly has a longitudinal axis which extends between the swing arm axis and the pivot axis so that the force of the breakout hydraulic assembly creates a moment biasing the swing arm toward the pipe section.

The pipe section is gripped by two dies mounted on the wrench member and by one die mounted on the clamping jaw. Each die is held in place by upper and lower fasteners. Shims can be inserted behind each die to adjust the position of the die. Each shim has therein an aperture through which the upper fastener extends to hold the shim in place. The bottom of each shim has therein an upwardly extending slot through which the lower fastener extends. The shim is removed by loosening the lower fastener and by removing the upper fastener from the shim aperture. The slot in the shim allows upward movement of the shim relative to the lower fastener, while the lower fastener maintains the position of the shim.

Other features and advantages of the invention will become apparent to those skilled in the art upon review of the following detailed description, claims and drawings.

DESCRIPTION OF THE DRAWINGS

FIG. 7 is a view taken along line 7—7 in FIG. 4.

Figure 1:
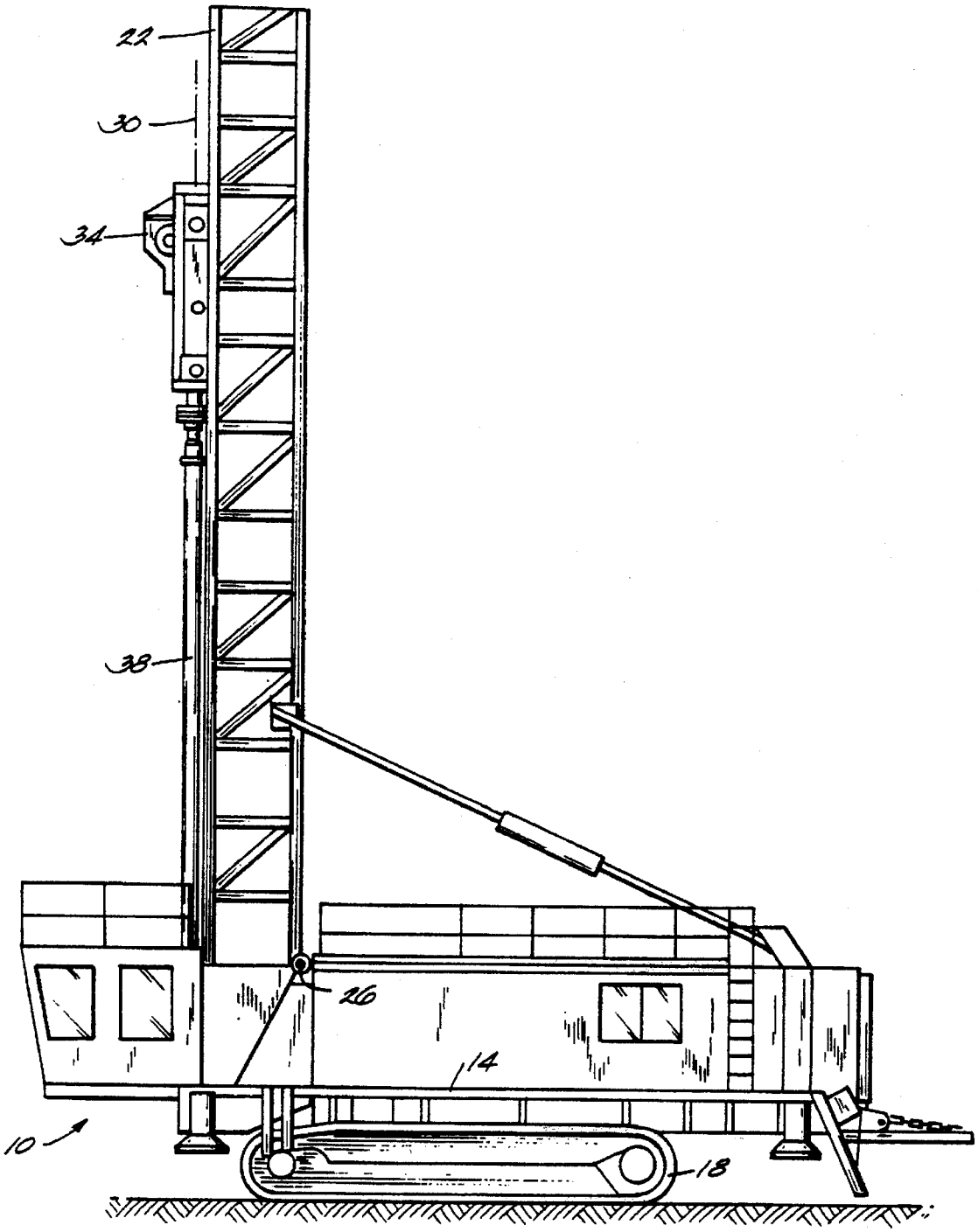
FIG. 1 is a side elevational view of a blasthole drill embodying the invention.
Figure 1:
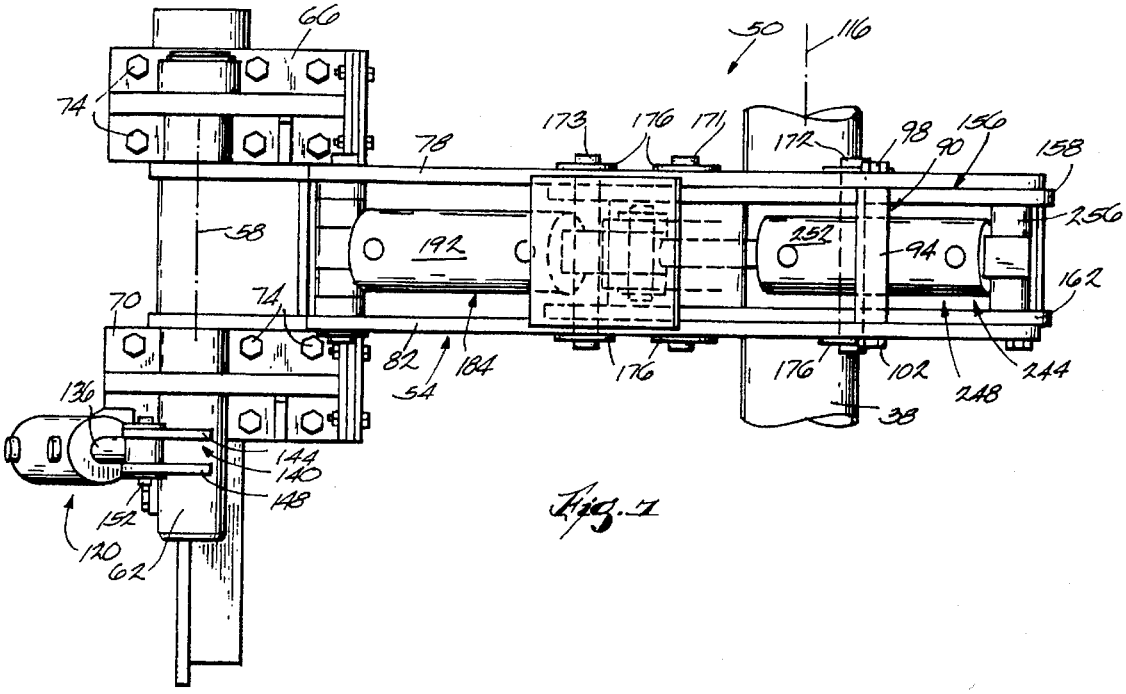

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 2:
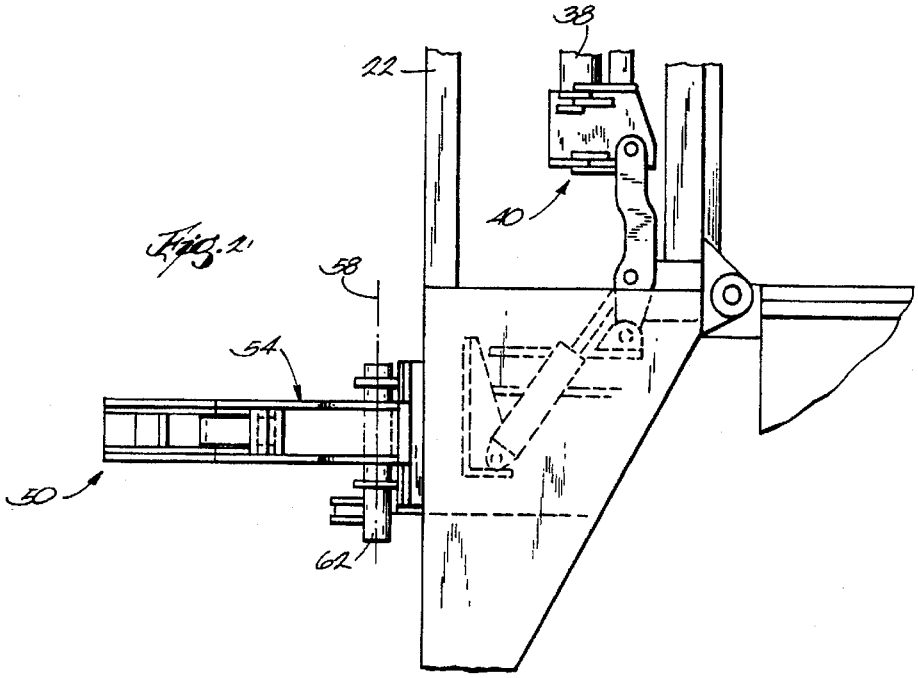
FIG. 2 is an enlarged partial side elevational view of the blasthole drill.
Figure 3:
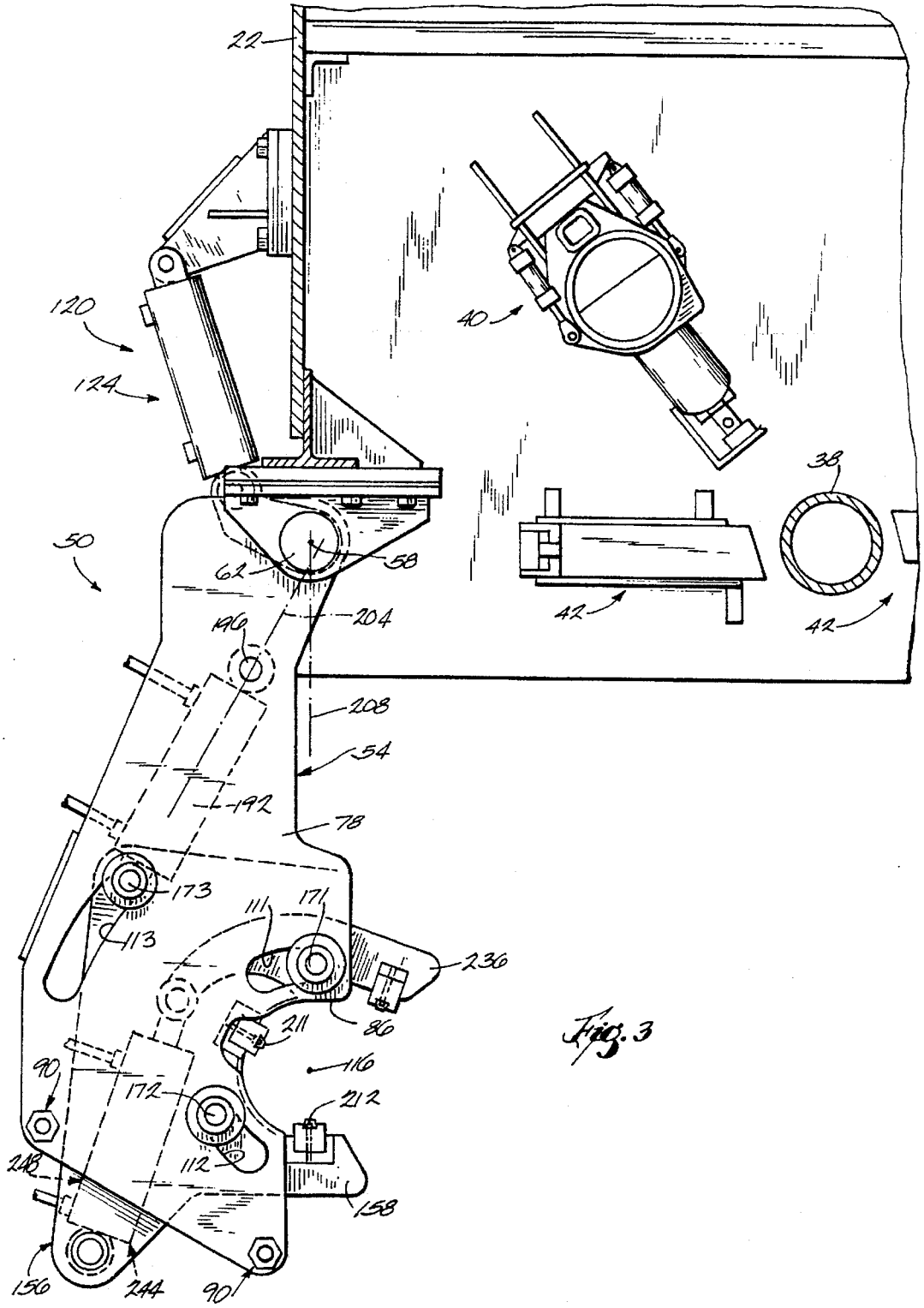
FIG. 3 is partial top plan view of the portion of the blasthole drill shown in FIG. 2.

A blasthole drill 10 embodying the invention is illustrated in FIG. 1. The blasthole drill 10 comprises a frame 14 supported by crawlers 18 for movement over the ground. A mast 22 is supported by the frame 14 for movement relative thereto about a generally horizontal axis 26 and between a substantially vertical position (shown in FIG. 1) and a number of angled or non-vertical positions (not shown). The mast 22 defines a drill hole axis 30. A rotary head 34 is moveable relative to the mast 22 along the drill hole axis 30. The rotary head 34 is selectively engageable with the upper end of a drill pipe section 38 supported relative to the mast 22. A number of drill pipe sections are supported for movement relative to the mast 22 by a pipe rack 40 (FIGS. 2 and 3). The pipe rack 40 is movable relative to the mast for moving a drill pipe section 38 between an operating position wherein the drill pipe section extends along the drill hole axis 30 and a non-operating position wherein the drill pipe section is spaced from the drill hole axis. A pair of deck wrenches 42 (FIG. 3) are mounted on the bottom plate 46 of the mast 22. As is known in the art, the deck wrenches 42 selectively engage a drill pipe section to facilitate disconnection of two sections. The blasthole drill 10 as thus far described is conventional and will not be described in greater detail.

A suitable pipe rack is disclosed in U.S. Ser. No. 08/270,959, which is incorporated herein by reference. Except as described below, the blasthole drill 10 is identical to the drill disclosed in U.S. Ser. No. 08/270,959.

The blasthole drill 10 also comprises (see FIGS. 2–7) an improved automatic breakout wrench 50. The breakout wrench 50 is operable, as described below, to turn an upper pipe section 38 relative to a lower pipe section 38 held by the deck wrenches 42 to disengage or unthread the pipe sections. For purposes of the following description, it will be assumed that the mast 22 is in its vertical position, so that the drill hole axis 30 and all parallel axes extend vertically. Obviously, the orientation of the axes and other components of the breakout wrench 50 will change if the orientation of the mast 22 changes.

The breakout wrench 50 includes (see FIGS. 3 and 7) a swing arm 54 mounted on the mast 22 for pivotal movement relative thereto about a swing arm axis 58 parallel to the drill hole axis 30. The swing arm 54 includes a cylindrical tube 62 extending along the swing arm axis 58. The tube 62 is supported for pivotal movement relative to the mast 22 by (see FIG. 7) upper and lower mounting brackets 66 and 70 fixed to the mast 22 by suitable means such as bolts 74. The swing arm 54 also includes substantially identical, spaced upper and lower plates 78 and 82 welded or otherwise fixed to the tube 62 for pivotal movement therewith. Each of the swing arm plates 78 and 82 has therein (see FIG. 3) a generally semi-circular recess 86 into which a pipe section 38 on the drill hole axis 30 extends when the swing arm 54 is in its extended position. The spacing of the plates 78 and 82 is maintained by the connection of the plates to the tube 62 and by (see FIGS. 5–7) spacing assemblies 90 connecting the outer ends of the plates. Each spacing assembly 90 includes (see FIGS. 6 and 7) a sleeve-like spacer 94 between the plates 78 and 82, a bolt 98 extending through the plates 78 and 82 and through the spacer 94, and a nut 102 (see FIG. 7) threaded onto the bolt 98. Each of the plates 78 and 82 has therein (see FIGS. 3 and 6) first, second and third arcuate slots 111, 112 and 113, respectively, centered on a pivot axis 116 which is fixed relative to the swing arm 54 and which is parallel to the swing arm axis 58. The slots 111, 112 and 113 are arcuately spaced from each other, i.e., they are not located along a single line extending radially from the pivot axis 116. The first and second slots 111 and 112 are equidistant from the pivot axis 116, i.e., they extend along the same circle centered on the pivot axis 116. The third slot 113 is spaced from the pivot axis 116 a distance substantially greater than the distance the first and second slots 111 and 112 are spaced from the pivot axis 116. In the illustrated construction, the second slot 112 is approximately two and one-half times as far from the pivot axis 116 as the first and second slots 111 and 112. The purpose of the slots is explained below.

Figure 4:
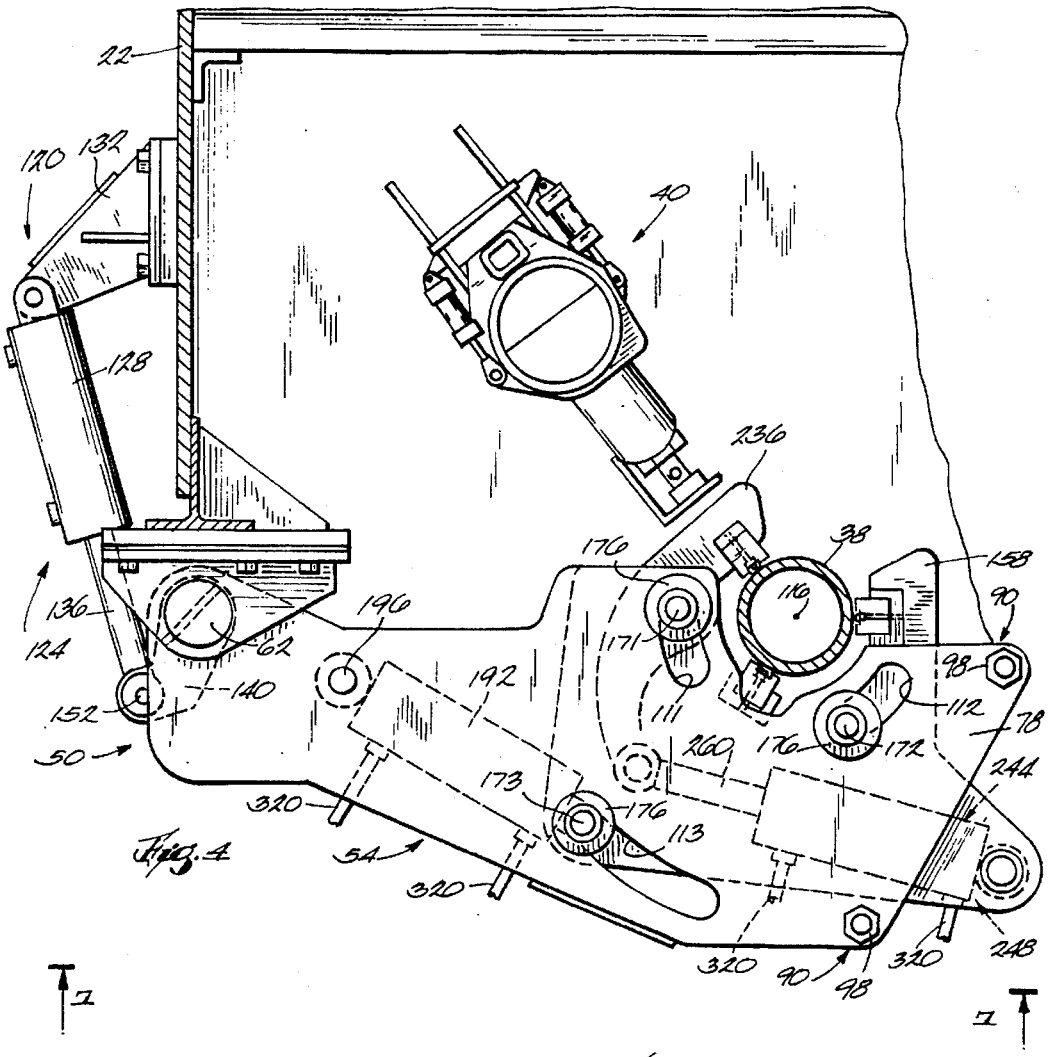
FIG. 4 is a view similar to FIG. 3 showing a pipe section gripped by the breakout wrench prior to turning of the pipe section.
Figure 6:
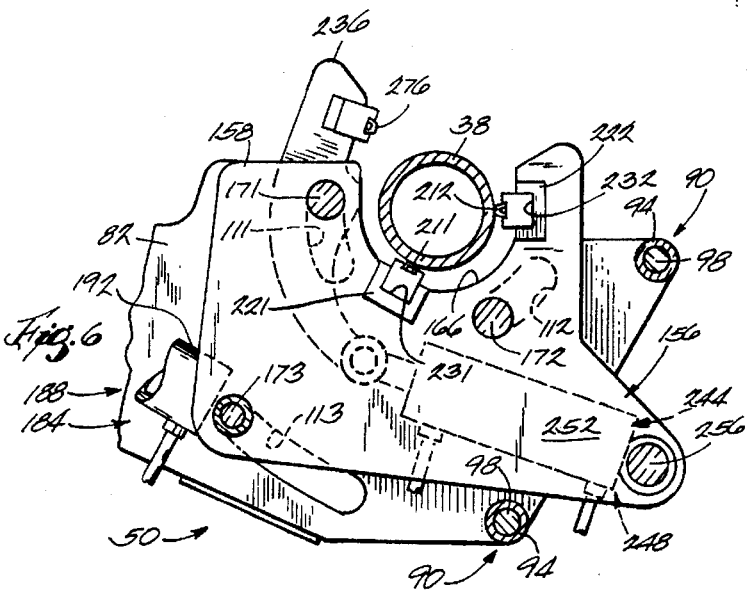
FIG. 6 is a view similar to FIG. 4 with portions removed for clarity and with the clamping jaw in its non-clamping position.

The breakout wrench 50 also includes (see FIGS. 3 and 7) a mechanism 120 for pivoting the swing arm 54 relative to the mast 22 and between an extended position shown in FIG. 4 and a retracted position shown in FIG. 3. When the swing arm 54 is in its extended position, the pivot axis 116 is coaxial with the drill hole axis 30. While various suitable mechanisms can be employed, in the illustrated construction, the mechanism 120 includes (see FIG. 4) a swing hydraulic assembly 124 connected between the mast 22 and the swing arm 54. The hydraulic assembly 124 includes a cylinder 128 having its closed end pivotally connected to the mast 22 via a clevis 132 fixed to the mast 22. The hydraulic assembly 124 also includes a piston (not shown) slideably housed in the cylinder 128, and a piston rod 136 having one end fixed to the piston and an opposite end pivotally connected to the swing arm 54. Specifically, the outer end of the piston rod 136 is pivotally connected to an arm 140 which extends radially from the tube 62 and which is fixed to the tube 62 by a suitable means such as welding. As shown in FIG. 7, the arm 140 includes upper and lower plates 144 and 148 fixed to the tube 62. The outer end of the piston rod 136 extends between the plates 144 and 148 and is pivotally connected to the plates by a pin 152.

It should be understood that many other types of mechanisms can be used to pivot the swing arm 54. Suitable alternative mechanisms include, but are not limited to, electric motors and rotary hydraulic motors.

The breakout wrench 50 also includes (see FIGS. 6 and 7) a wrench member 156 supported by the swing arm 54 for pivotal movement relative to the swing arm 54 about the pivot axis 116. The wrench member 156 extends between the swing arm plates 78 and 82 and includes (see FIG. 7)

spaced upper and lower plates 158 and 162 respectively located adjacent the swing arm plates 78 and 82. Each of the wrench member plates 158 and 162 has therein (see FIG. 6) a generally semi-cylindrical recess 166 aligned with the recesses 86 in the swing arm plates 78 and 82. First, second and third pins 171, 172 and 173 extend between the plates 158 and 162 and through the first, second and third slots 111, 112 and 113, respectively, of the swing arm plates 78 and 82. Each of the pins 171, 172 and 173 has a diameter slightly less than the width of the associated slot so that each pin can move along the associated slot and thereby guide pivotal movement of the wrench member 156 relative to the swing arm 54. Each of the pins 171, 172 and 173 is surrounded by (see FIGS. 4 and 7) a washer 176 above the swing arm upper plate 78, and the upper end of each of the pins 171, 172 and 173 has therethrough a cotter pin (not shown) above the associated washer. Each of the pins 171, 172 and 173 is surrounded by (see FIG. 7) a washer 176 below the swing arm lower plate 82, and the lower end of each of the pins has therethrough a cotter pin (not shown) below the associated washer.

Figure 5:
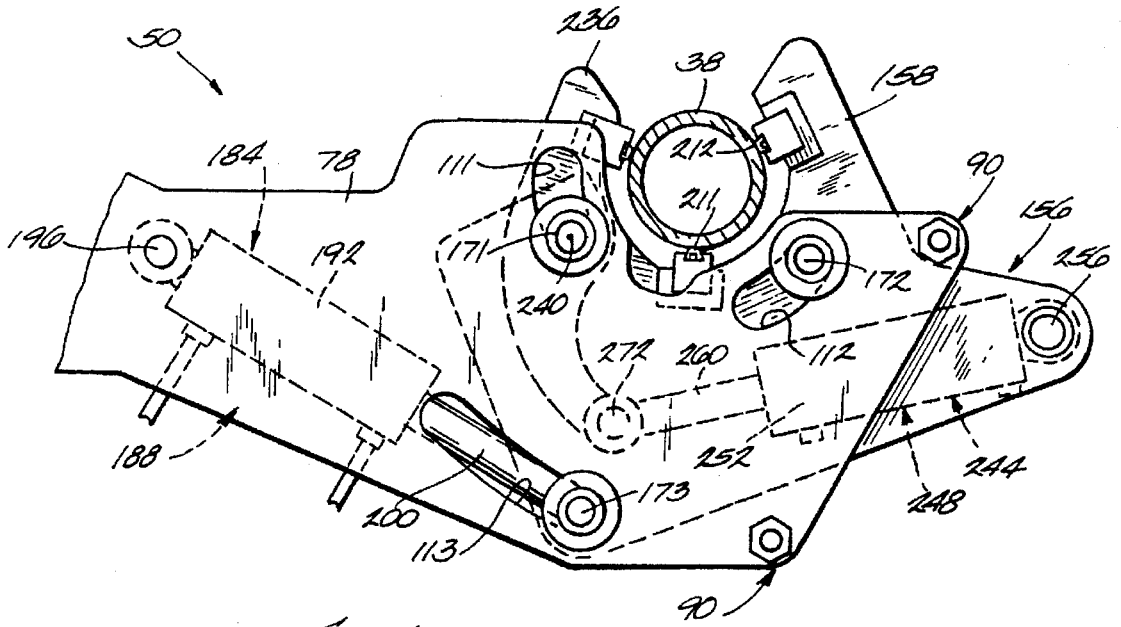
FIG. 5 is a view similar to FIG. 4 showing the breakout wrench after turning of the pipe section.

The breakout wrench 50 also includes (see FIGS. 5 and 7) a mechanism 184 for pivoting the wrench member 156 relative to the swing arm 54 and about the pivot axis 116. The wrench member 156 moves between a starting position (FIGS. 4 and 6) and a breaking position (FIG. 5). Each of the slots 111, 112 and 113 has an arcuate extent of approximately twenty-four degrees so that the wrench member 156 pivots twenty-four degrees between the starting and breaking positions. In the illustrated construction, the mechanism 184 includes a breakout hydraulic assembly 188 located between the swing arm plates 78 and 82 and the wrench member plates 158 and 162 and connected between the swing arm 54 and the wrench member 156. The hydraulic assembly 188 includes a cylinder 192 having its closed end pivotally connected to a pin 196 extending between the swing arm plates 78 and 82. The hydraulic assembly 188 also includes a piston (not shown) slideably housed in the cylinder 192, and a piston rod 200 (see FIG. 5) having one end fixed to the piston and an opposite end pivotally connected to the third pin 173 and thus to the wrench member 156. The cylinder 192 extends along (see FIG. 3) a horizontal axis 204 (i.e., a line in a plane perpendicular to the drill hole axis 30) which intersects the plane 208 including the swing arm axis 58 and the pivot axis 116 at a point between the swing arm axis 58 and the pivot axis 116. The significance of this location of the cylinder axis 204 is that, when the hydraulic assembly 188 is extended as described below to break a joint, the force of the assembly 188 on the swing arm 54 creates a moment biasing the swing arm toward its extended position.

The breakout wrench 50 also includes (see FIG. 6) first and second dies 211 and 212 mounted on the wrench member 156 so as to engage a drill pipe section 38 extending along the drill hole axis 30 when the swing arm 54 is in its extended position, as shown in FIG. 4. The dies 211 and 212 are supported in respective channel-shaped housings 221 and 222 extending between the wrench member plates 158 and 162. The housings 221 and 222 respectively define rectangular recesses 231 and 232 in which the dies 211 and 212 are respectively mounted in a manner described below.

The breakout wrench 50 also includes (see FIGS. 4–6) a clamping jaw 236 supported by the wrench member 156 for pivotal movement relative to the wrench member 156 about a clamping jaw axis 240 (see FIG. 5) parallel to the pivot axis 116. The clamping jaw 236 extends between the wrench member plates 158 and 162. In the illustrated construction, the clamping jaw 236 is an arcuate block of metal having inner and outer ends (lower and upper ends in FIG. 5) and horizontal upper and lower surfaces respectively located adjacent the upper and lower wrench member plates 158 and 162. The clamping jaw 236 has therethrough a cylindrical bore (not shown) through which the first pin 171 extends such that the clamping jaw 236 pivots about the first pin 171. The clamping jaw 236 is located inside the pivot axis 116, i.e., the clamping jaw axis 240 is spaced from the swing arm axis 58 a distance less than the distance between the pivot axis 116 and the swing arm axis 58. In other words, the clamping jaw 236 is located inside a pipe section 38 on the drill hole axis 30 when the swing arm 54 is in the extended position.

The breakout wrench 50 also includes a mechanism 244 for pivoting the clamping jaw 236 relative to the wrench member 156 and about the clamping jaw axis 240. The clamping jaw 236 pivots between a clamping position shown in FIG. 4 and a non-clamping position shown in FIG. 6. In the illustrated construction, the mechanism 244 includes a clamping hydraulic assembly 248 located between the wrench member plates 158 and 162 and connected between the wrench member 156 and the inner end of the clamping jaw 236. The hydraulic assembly 248 includes (see FIG. 5) a cylinder 252 having its closed end pivotally connected to a pin 256 extending between the wrench member plates 158 and 162. The hydraulic assembly 248 also includes a piston (not shown) slideably housed in the cylinder 252, and a piston rod 260 having one end fixed to the piston and an opposite end pivotally connected to the inner end of the clamping jaw 236. More particularly, the inner end of the jaw 236 has thereon spaced upper and lower ears (not shown), and the outer end of the piston rod 260 extends between the ears and is connected thereto by a pin 272 (see FIG. 5).

The breakout wrench 50 also includes a third die 276 (see FIGS. 6 and 8–10) mounted on the clamping jaw 236 so as to engage a drill pipe section 38 extending along the drill hole axis 30 when the swing arm 54 is in its extended position and the clamping jaw 236 is in its clamping position, as shown in FIG. 4. The die 276 is supported in (see FIGS. 8 and 10) a rectangular recess 280 in the clamping jaw 236.

Figure 8:
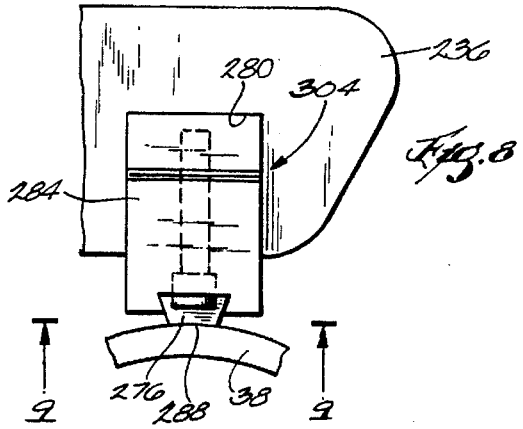
FIG. 8 is an enlarged portion of FIG. 4.
Figure 9:
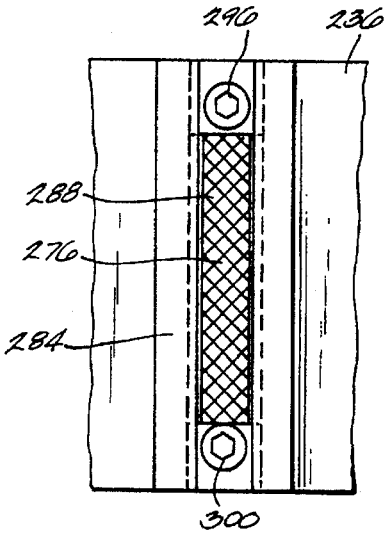
FIG. 9 is a view taken along line 9—9 in FIG. 8.
Figure 10:
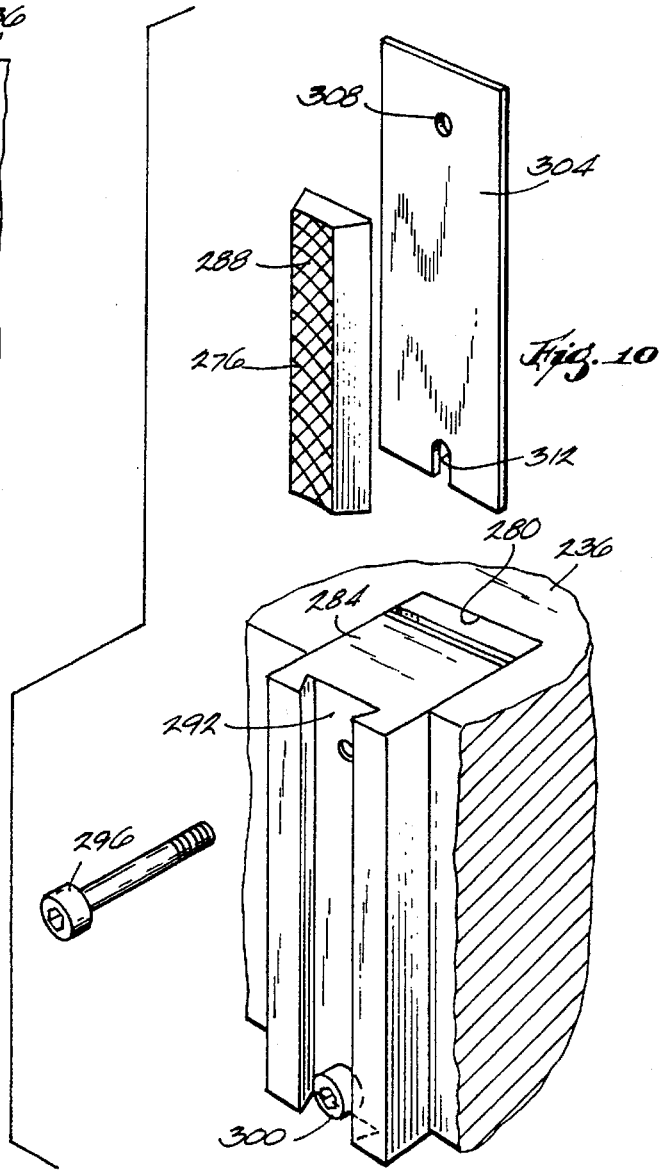
FIG. 10 is an exploded view of the arrangement for mounting one of the dies.

The dies 211, 212 and 276 are mounted in their respective recesses 231, 232 and 280 in the same manner, and only the mounting of the die 276 will be described in detail. The position of the die 276 relative to the clamping jaw 236 is adjustable to allow for pipe wear and for different pipe sizes. The die 276 is mounted on a rectangular block 284 (see FIGS. 8–10) which is in turn mounted on the clamping jaw 236 in a manner described below. As shown in FIGS. 8 and 10, the die 276 has a curved gripping surface 288 (curved to match the pipe section 38) and is otherwise trapezoidal. The inner surface of the block 284 has therein (see FIG. 10) a trapezoidal recess 292 into which the die 276 slides vertically so that, when the die 276 is in the recess 292, the die 276 cannot move horizontally relative to the block 284. It can be appreciated that the die 276 and the recess 292 can have different shapes and still allow vertical movement of the die while preventing horizontal movement.

The die 276 is secured vertically relative to the block 284 and the block 284 is secured to the clamping jaw 236 by (see FIGS. 9 and 10) upper and lower fasteners 296 and 300 extending through the block 284 and into the clamping jaw 236. While various suitable fasteners can be employed, in the illustrated construction the fasteners 296 and 300 are screws or bolts. As shown in FIG. 9, the die 276 is located between the heads of the fasteners 296 and 300 and is thereby secured vertically relative to the block 284 when the fasteners 296 and 300 are threaded into the clamping jaw 236. As shown in FIGS. 8 and 10, shims 304 can be placed between the block 284 and the clamping jaw 236 to adjust the position of the die 276 relative to the clamping jaw 236. As best shown in FIG. 10, each shim 304 has therein an aperture 308 through which the upper fastener 296 extends to hold the shim 304 in place. The bottom or lower end of each shim 304 has therein an upwardly extending slot 312 through which the lower fastener 300 extends. A shim 304 can be removed by unthreading the upper fastener 296 and removing it from the aperture 308 while simply loosening the lower fastener 300, without completely unthreading the lower fastener 300. When the lower fastener 300 is loosened, the slot 312 allows upward movement of the shim 304 relative to the lower fastener 300 so that the shim 304 can be removed from between the block 284 and the clamping jaw 236. Thus, the lower fastener 300 holds the block 284 in place relative to the clamping jaw 236 and also prevents the die 276 from falling downwardly out of the recess 292 while shims 304 are inserted or removed. The dies 211 and 212 are adjustable in the same manner.

The blasthole drill 10 operates as follows. With a bit and stabilizer (not shown) secured by the deck wrenches 42, the pipe rack 40 is actuated to locate a pipe section 38 over the drill hole. The rotary head 34 is then lowered and screwed onto the top joint of the pipe section 38. After this joint is made, the pipe section 38 is released by the pipe rack, the rotary head 34 and attached pipe section 38 are lowered, and the lower end of the pipe section 38 is attached to the stabilizer held by the deck wrenches 42. With this joint connection complete, the deck wrenches 42 retract and the rotary head 34 and pipe section 38 can be further lowered.

To remove a pipe section 38, the joint is brought up to the deck and the lower pipe section 38 is secured with the deck wrenches 42. If the joint cannot be broken loose with the rotary head 34, the breakout wrench 50 is used as follows.

Two switches (not shown) on the operator's console operate the breakout wrench 50. The switches operate a hydraulic control system (not shown) connected to the three cylinders 128, 192 and 252 by hydraulic lines 320 (partially shown in FIG. 4). Any suitable hydraulic control system can be employed. The first switch swings the wrench 50 in and out, i.e., moves the swing arm 54 between its extended and retracted positions. The second switch engages and disengages the wrench 50, i.e., controls the breakout and clamping cylinders 192 and 252.

The operator initially pushes the first switch to extend the hydraulic assembly 124 and move the swing arm 54 to its extended position (see FIG. 4). This causes the dies 211 and 212 to engage the upper pipe section. The operator then pushes the second switch. This causes the clamping hydraulic assembly 248 to move the clamping jaw 236 to its clamping position (see FIG. 4), so that the die 276 engages the upper pipe section. Once the pipe section is clamped and hydraulic pressure has reached the required level, a sequence valve (not shown) shifts the hydraulic pressure to the breakout cylinder 192 so that hydraulic assembly 188 extends and the wrench member 156 moves from its starting position to its breaking position (see FIG. 5), thereby breaking the joint. The wrench member 156 pivots relative to the swing arm 54 until the breakout hydraulic assembly 188 reaches maximum stroke and stops. The operator then pushes the second switch again. This causes the clamping jaw 236 to return to its non-clamping position and causes the wrench member 156 to return to its starting position. This process can be repeated if it is necessary to further unscrew the joint threads. When the breakout wrench 50 is no longer needed, the first switch is pushed to cause the swing arm 54 to return to its extended position.

Various features of the invention are set forth in the following claims.

I claim:

1. A blasthole drill comprising:

a frame supported for movement over the ground, a mast supported by said frame, said mast defining a drill hole axis, and an automatic breakout wrench for turning one drill pipe section relative to another drill pipe section to disengage the drill pipe sections, said breakout wrench including a wrench member supported for pivotal movement relative to said mast about a pivot axis which is coaxial with said drill hole axis when said swing arm is in said extended position, a clamping jaw supported by said wrench member for movement relative to said wrench member between clamping and non-clamping positions, a die which is mounted on one of said wrench member and said clamping jaw and which engages the one drill pipe section extending along said drill hole axis when said swing arm is in said extended position and said clamping jaw is in said clamping position, said die being supported by upper and lower fasteners engaging said one of said wrench member and said clamping jaw, and at least one shim between said die and said one of said wrench member and said clamping jaw, said shim having therein an aperture through which said upper fastener extends to hold said shim in place, and said shim having a lower end having therein an upwardly extending slot through which said lower fastener extends, said slot having an open lower end, such that said shim is removable by withdrawing said upper fastener to remove said upper fastener from said aperture and by loosening said lower fastener, without completely withdrawing said lower fastener, so that said slot allows upward movement of said shim relative to said lower fastener, such that when said wrench member and said clamping jaw engage a drill pipe section, pivotal movement of said wrench member relative to said swing arm turns the engaged drill pipe section relative to said swing arm.

2. A blasthole drill as set forth in claim 1 and further comprising a swing arm mounted for movement relative to said mast between extended and retracted positions, and wherein said wrench member is supported by said swing arm.

3. A blasthole drill as set forth in claim 2 wherein said swing arm is mounted on said mast.

4. A blasthole drill as set forth in claim 1 wherein said fasteners threadedly engage said one of said wrench member and said clamping jaw.

5. A blasthole drill as set forth in claim 1 and further comprising a block mounted on said one of said wrench member and said clamping jaw, said block having therein a trapezoidal recess into which said die slides vertically so that, when said die is in said recess, said die cannot move horizontally relative to said block, said die being secured vertically relative to said block and said block being secured to said one of said wrench member and said clamping jaw by said upper and lower fasteners.

6. A blasthole drill as set forth in claim 5 wherein said fasteners have respective heads, said die being located between said heads and thereby secured vertically relative to said block when said fasteners are secured to said one of said wrench member and said clamping jaw.

7. A blasthole drill comprising:

a frame supported for movement over the ground, a mast supported by said frame, said mast defining a drill hole axis, and an automatic breakout wrench for turning one drill pipe section relative to another drill pipe section to disengage the drill pipe sections, said breakout wrench including a swing arm mounted for movement relative to said mast between extended and retracted positions, said swing arm having therein first, second and third arcuate slots centered on a pivot axis which is coaxial with said drill hole axis when said swing arm is in said extended position, said slots being arcuately spaced relative to each other, a wrench member supported by said swing arm for pivotal movement about said pivot axis, said wrench member having thereon first, second and third pins respectively received in said first, second and third slots for guiding pivotal movement of said wrench member relative to said swing arm, and a clamping jaw supported by said wrench member for movement relative to said wrench member between clamping and non-clamping positions, such that when said wrench member and said clamping jaw engage the one drill pipe section, pivotal movement of said wrench member relative to said swing arm turns the engaged drill pipe section relative to said swing arm.

8. A blasthole drill as set forth in claim 7 wherein said third slot is spaced from said pivot axis a distance substantially greater than the distance said first and second slots are spaced from said pivot axis.

9. A blasthole drill as set forth in claim 8 and further comprising a breakout hydraulic assembly connected between said swing arm and said third pin for pivoting said wrench member relative to said swing arm and about said pivot axis.

10. A blasthole drill as set forth in claim 7 wherein said swing arm is mounted on said mast.

11. A blasthole drill as set forth in claim 7 wherein said clamping jaw is pivotally mounted on one of said first and second pins.

12. A blasthole drill comprising:

a frame supported for movement over the ground, a mast supported by said frame, said mast defining a drill hole axis, and an automatic breakout wrench for turning one drill pipe section relative to another drill pipe section to disengage the drill pipe sections, said breakout wrench including a swing arm mounted for pivotal movement relative to said mast about a swing arm axis generally parallel to said drill hole axis and between extended and retracted positions, a wrench member supported by said swing arm for pivotal movement about a pivot axis which is coaxial with said drill hole axis when said swing arm is in said extended position, a breakout hydraulic assembly connected between said swing arm and said wrench member for pivoting said wrench member relative to said swing arm and about said pivot axis, said breakout hydraulic assembly including a hydraulic cylinder and piston assembly extending along an axis which intersects a plane including said swing arm axis and said pivot axis at a point between said swing arm axis and said pivot axis, and a clamping jaw supported by said wrench member for movement relative to said wrench member between clamping and non-clamping positions, such that when said wrench member and said clamping jaw engage the one drill pipe section, extension of said breakout hydraulic assembly pivots said wrench member and said clamping jaw about said pivot axis to turn the engaged drill pipe section relative to said swing arm, and such that extension of said breakout hydraulic assembly exerts on said swing arm a force creating a moment biasing said swing arm in the direction from said retracted position to said extended position.

13. A blasthole drill as set forth in claim 12 wherein said swing arm is mounted on said mast.

14. A blasthole drill comprising:

a frame supported for movement over the ground, a mast supported by said frame, said mast defining a drill hole axis, and an automatic breakout wrench for turning one drill pipe section relative to another drill pipe section to disengage the drill pipe sections, said breakout wrench including a swing arm mounted for movement relative to said mast between extended and retracted positions, said swing arm having therein first and second arcuate slots centered on a pivot axis which is coaxial with said drill hole axis when said swing arm is in said extended position, said slots being arcuately spaced relative to each other, a wrench member supported by said swing arm for pivotal movement about said pivot axis, said wrench member having thereon first and second pins respectively received in said first and second slots for guiding pivotal movement of said wrench member relative to said swing arm, and a clamping jaw supported on said first pin for pivotal movement relative to said wrench member between clamping and non-clamping positions, such that when said wrench member and said clamping jaw engage the one drill pipe section, pivotal movement of said wrench member relative to said swing arm turns the engaged drill pipe section relative to said swing arm.

15. A blasthole drill as set forth in claim 14 wherein said swing arm is mounted on said mast.

16. A blasthole drill comprising:

a frame supported for movement over the ground, a mast supported by said frame, said mast defining a drill hole axis, a pipe rack supported by said mast, said pipe rack being movable relative to said mast for moving a drill pipe section between an operating position wherein the drill pipe section extends along said drill hole axis and a non-operating position wherein the drill pipe section is spaced from said drill hole axis, and an automatic breakout wrench for turning one drill pipe section relative to another drill pipe section to disengage the drill pipe sections, said breakout wrench including a swing arm mounted on said mast for pivotal movement relative thereto between extended and retracted positions and about a swing arm axis generally parallel to said drill hole axis, said swing arm having therein first, second and third arcuate slots centered on a pivot axis which is coaxial with said drill hole axis when said swing arm is in said extended position, said slots being arcuately spaced relative to each other, said third slot being spaced from said pivot axis a distance substantially greater than the distance said first and second slots are spaced from said pivot axis, a swing hydraulic assembly connected between said mast and said swing arm for pivoting said swing arm about said swing arm axis between extended and retracted positions, a wrench member supported by said swing arm for pivotal movement about said pivot axis, said wrench member having thereon first, second and third pins respectively received in said first, second and third slots for guiding pivotal movement of said wrench member relative to said swing arm, a breakout hydraulic assembly connected between said swing arm and said third pin for pivoting said wrench member relative to said swing arm and about said pivot axis, said breakout hydraulic assembly including a hydraulic cylinder and piston assembly extending along a generally horizontal axis which intersects a plane including said swing arm axis and said pivot axis at a point between said swing arm axis and said pivot axis, a clamping jaw supported by said first pin for pivotal movement relative to said wrench member about a clamping jaw axis generally parallel to said pivot axis, said clamping jaw axis being spaced from said swing arm axis a distance less than the distance between said pivot axis and said swing arm axis, a clamping hydraulic assembly connected between said wrench member and said clamping jaw for pivoting said clamping jaw relative to said wrench member and about said clamping jaw axis between clamping and non-clamping positions, first and second dies which are mounted on said wrench member and which engage the one drill pipe section extending along said drill hole axis when said swing arm is in said extended position, a third die which is mounted on said clamping jaw and which engages the one drill pipe section extending along said drill hole axis when said swing arm is in said extended position and said clamping jaw is in said clamping position, each of said first and second dies being supported by upper and lower fasteners threadedly engaging said wrench member, and said third die being supported by upper and lower fasteners engaging said clamping jaw, and at least one shim between one of said dies and the associated one of said wrench member and said clamping jaw, said shim having therein an aperture through which the associated upper fastener extends to hold said shim in place, and said shim having a lower end having therein an upwardly extending slot through which the associated lower fastener extends, such that said shim is removable by unthreading the associated upper fastener to remove the associated upper fastener from said aperture and by loosening the associated lower fastener, without completely unthreading the associated lower fastener, so that said slot allows upward movement of said shim relative to the associated lower fastener, such that when said first, second and third dies engage a drill pipe section, extension of said breakout hydraulic assembly pivots said wrench member and said clamping jaw about said pivot axis to turn the engaged drill pipe section relative to said swing arm, and such that extension of said breakout hydraulic assembly exerts on said swing arm a force creating a moment biasing said swing arm in the direction from said retracted position to said extended position.

17. A method of removing a shim from an automatic breakout wrench of a blasthole drill, said blasthole drill comprising a frame supported for movement over the ground, a mast supported by said frame, said mast defining a drill hole axis, and an automatic breakout wrench for turning one drill pipe section relative to another drill pipe section to disengage the drill pipe sections, said breakout wrench including a wrench member supported for pivotal movement relative to said mast about a pivot axis which is coaxial with said drill hole axis when said swing arm is in said extended position, a clamping jaw supported by said wrench member for movement relative to said wrench member between clamping and non-clamping positions, a die which is mounted on one of said wrench member and said clamping jaw and which engages the one drill pipe section extending along said drill hole axis when said swing arm is in said extended position and said clamping jaw is in said clamping position, said die being supported by upper and lower fasteners engaging said one of said wrench member and said clamping jaw, and at least one shim between said die and said one of said wrench member and said clamping jaw, said shim having therein an aperture through which said upper fastener extends to hold said shim in place, and said shim having a lower end having therein an upwardly extending slot through which said lower fastener extends, said slot having an open lower end, such that when said wrench member and said clamping jaw engage a drill pipe section, pivotal movement of said wrench member relative to said swing arm turns the engaged drill pipe section relative to said swing arm, said method comprising the step of removing said shim by withdrawing said upper fastener to remove said upper fastener from said aperture and by loosening said lower fastener, without completely withdrawing said lower fastener, so that said slot allows upward movement of said shim relative to said lower fastener.

* * * * *